United States Patent [19]

Brody

[11] 4,248,458

[45] Feb. 3, 1981

[54] RANDOM RACE WINNER SELECTOR DEVICE

[76] Inventor: Samuel M. Brody, 1417 N. Prospect Ave., #201, Milwaukee, Wis. 53202

[21] Appl. No.: 42,989

[22] Filed: May 29, 1979

[51] Int. Cl.[3] ..... B42D 15/00; G06C 17/00

[52] U.S. Cl. ..... 283/1 R; 283/49; 235/88 R

[58] Field of Search ..... 235/88 R; 283/1 R, 49

[56] References Cited

U.S. PATENT DOCUMENTS 4,181,090 1/1980 Calise ..... 235/88 R X

*Primary Examiner*—Paul A. Bell

*Attorney, Agent, or Firm*—Andrus, Sceales, Starke & Sawall

[57] ABSTRACT

A race horse selector includes three discs mounted on a common pivot pin behind a cover disc. Different sized discs are used to expose the outer margins. The margins are divided into equal sectors and numbers 1-12 randomly distributed thereon. The cover member has four spaced openings, one spanning all three discs to identify the win, place and show horses, and/or a Trifector race selection, an opposite one spanning the two outer discs to identify a Quinella or Perfecta race selection and two intermediate openings exposing the smallest and largest discs to identify the second half of a Daily Double and other selections. A locating tab on each disc extends radially outwardly of the cover disc with an outer clamp member extended back over or into the cover disc. Locating indicia on the back permits positioning the tabs such that a number sector is aligned within the openings, without viewing the openings. The bettor positions all three tabs and then reverses the assembly to uncover the numbered sectors on the discs aligned with the four openings.

9 Claims, 8 Drawing Figures

RANDOM RACE WINNER SELECTOR DEVICE

BACKGROUND OF THE INVENTION

This invention relates to a random race winner selector apparatus and particularly random race horse selector device for use by a bettor at a conventional race track for horse racing.

Horse racing is a widely enjoyed sport in the United States and other parts of the world. As employed herein a race horse includes trotters as well as the conventional racehorses. A participant attending a race track normally engages in placing a wager as to the horse which will win, with various wagers available. The bettor normally purchases various programs and betting sheets which not only identify the horses in the several separate races, but the betting permitted at each of the individual races. In addition, various publications are available and widely purchased by those in attendance which includes information on the characteristics of the track, the several horses and the jockey riding the horse that day, and the like. These publications are normally prepared by various recognized handicappers and include their expert opinion based on past performance data with respect to a particular horse and/or jockey. Such publications are relatively essential to a considered judgement in betting at a race track. Various types of multiple bets or wagers are of course provided, such as the Daily Double, the Quinella, the Perfecta, the Trifecta and the like. Such wagers are, of course, well known. The Daily Double requires a selection of the wining horse of the first and second races of the day. The Quinella requires the selection of two horses in a given race, and if either horse wins and the other runs second, a winning selection has been made. The Perfecta is similar to the Quinella except that the bettor must pick the one and two finishers in the exact order of finish in the race. A Trifecta provides for a similar selection by the bettor of the first, second and third finishers in the exact order of finish. In addition, of course, the bettor can provide for various other modifications, such as boxing of the selection.

Such systems of information are of course essentially noted above to a reasoned decision. However under certain instances, a bettor may desire not to go through such a reasoned judgement, and may desire to make some form of random, arbitrary selection.

SUMMARY OF THE PRESENT INVENTION

The present invention is directed to a simple race horse selector device for a random, unjudged selection in any given race or races. Thus, the selector device of this invention does not, of course, function in a manner to replace the expert judgement provided by the various racing publications and is intended merely as an alternate completely random and uninhibited chance selection means. Generally, in accordance with the present invention, the random horse selector of this invention includes three relatively movable elements and an interconnected cover member. The movable elements are mounted for movement relative to each other and to the cover member. Each of the movable elements is provided with a series of horse identifying number sections, such as 12 sections for racing in the United States. The sections of each element preferably have the same numbers arranged in the same order or sequence with respect to each other and with respect to a cover member. The cover member has a plurality of distributed opening means which may be of different sizes to expose different aligned portions of the movable elements. The opening means preferably include one which provides for alignment of a number section from each of the elements to provide three arbitrary selections for win, place and show as well as the selection for a trifecta race. A different second opening exposes the arbitrary selection for the second half of the Daily Double while a third opening provides for selection of a Quinella and/or Perfecta race selection. A final opening may provide additional numbers for substitution of a nonrunner or the like.

In a particularly unique embodiment of the invention, each element is a circular disc rotatably pinned to a circular cover member. The three discs are of respectively different sizes, with the outer peripherial portions divided and numbered. The discs are stacked in the relationship with the largest as the backing disc and the smallest as the frontmost disc. A cover disc is then secured over the stack with a central pin unit. The largest disc has the numbers on the outer periphery exposed, the second disc is located thereon with its number on its outer periphery exposed, and the smallest disc is located on the intermediate with its numbers exposed on its outer periphery. The cover member has four equicircumferentially spaced openings, one of which spans all three discs, an opposite one of which spans the outermost discs numbered sections while the intermediate two openings expose the smallest and largest discs. Each of the discs is preferably provided with a locating tab extending radially outwardly of the cover disc with an outer clamp member extended back over or into the cover disc. The backside of the assembly includes locating means for locating of the tabs such that a number sector is aligned within the openings. The locating tab for intermediate and the innermost disc are formed transparent, where aligned with the larger discs so as not to obscure or cover the number section on the next outer disc and aligned opening.

The several discs can be readily formed of any suitable materials such as paper, flexible plastic or the like with the numbers directly printed thereon and the tab members integrally or separately formed and interconnected thereto. Similarly the outer cover member can be formed of a suitable material such as paper, plastic, or even metal if so desired with the appropriate identifying matter applied thereto for convenient display of the numbers and the information.

In use, the selector is held by the bettor with the blank back side facing him. The several elements are then placed into any arbitrary relative position within the confines of a locating means. On reversing of the assembly, the arbitrarily selective identifying numbers will be presented in each of the several openings properly aligned for convenient reading.

The present device can thus be constructed as a simple inexpensive betting device particularly to relieve the pressure and intensity normally present when attending and laying wagers on the several races at a horse race.

DESCRIPTION OF THE DRAWING FIGURES

The drawings furnished herewith illustrates a preferred construction of the present invention in which the above advantages and features are clearly disclosed as well as others which will be readily understood from the following description.

DESCRIPTION OF ILLUSTRATED EMBODIMENT

Figure 1:
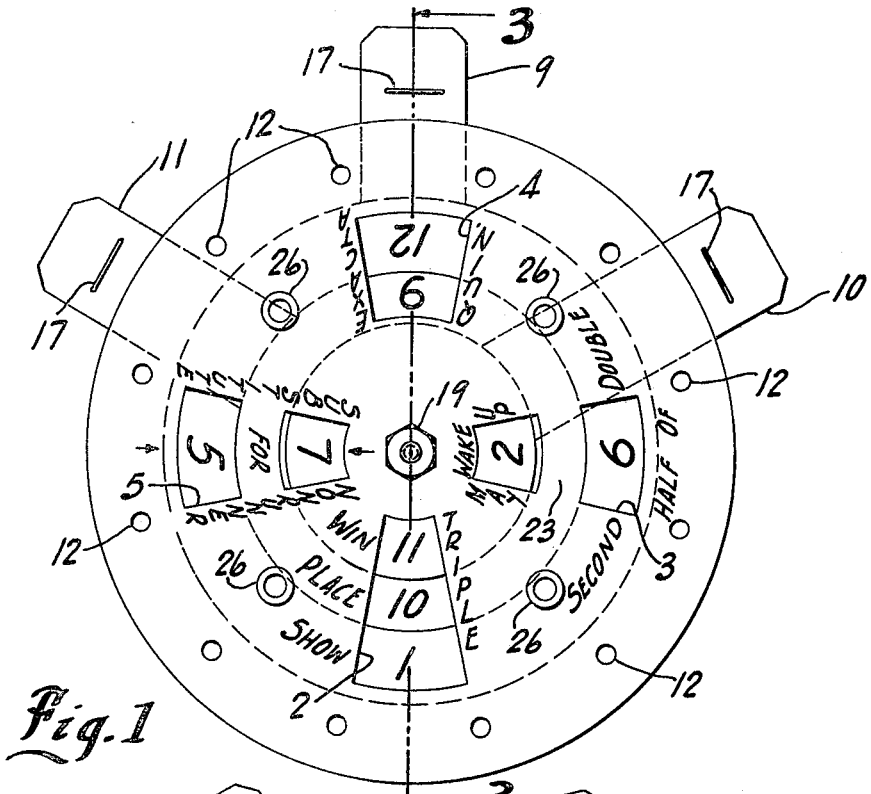
FIG. 1 is a plan elevational view of the selector constructed in accordance with the present invention.
Figure 3:
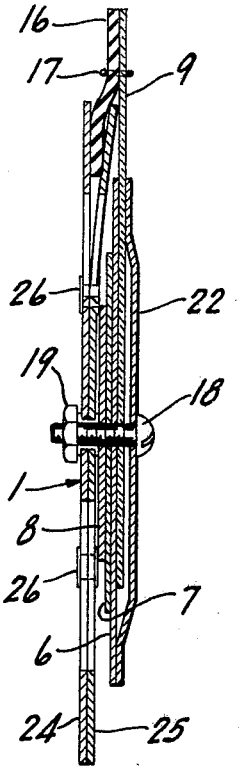
FIG. 3 is a vertical section taken generally on line 3—3 of FIG. 1.
Figure 2:
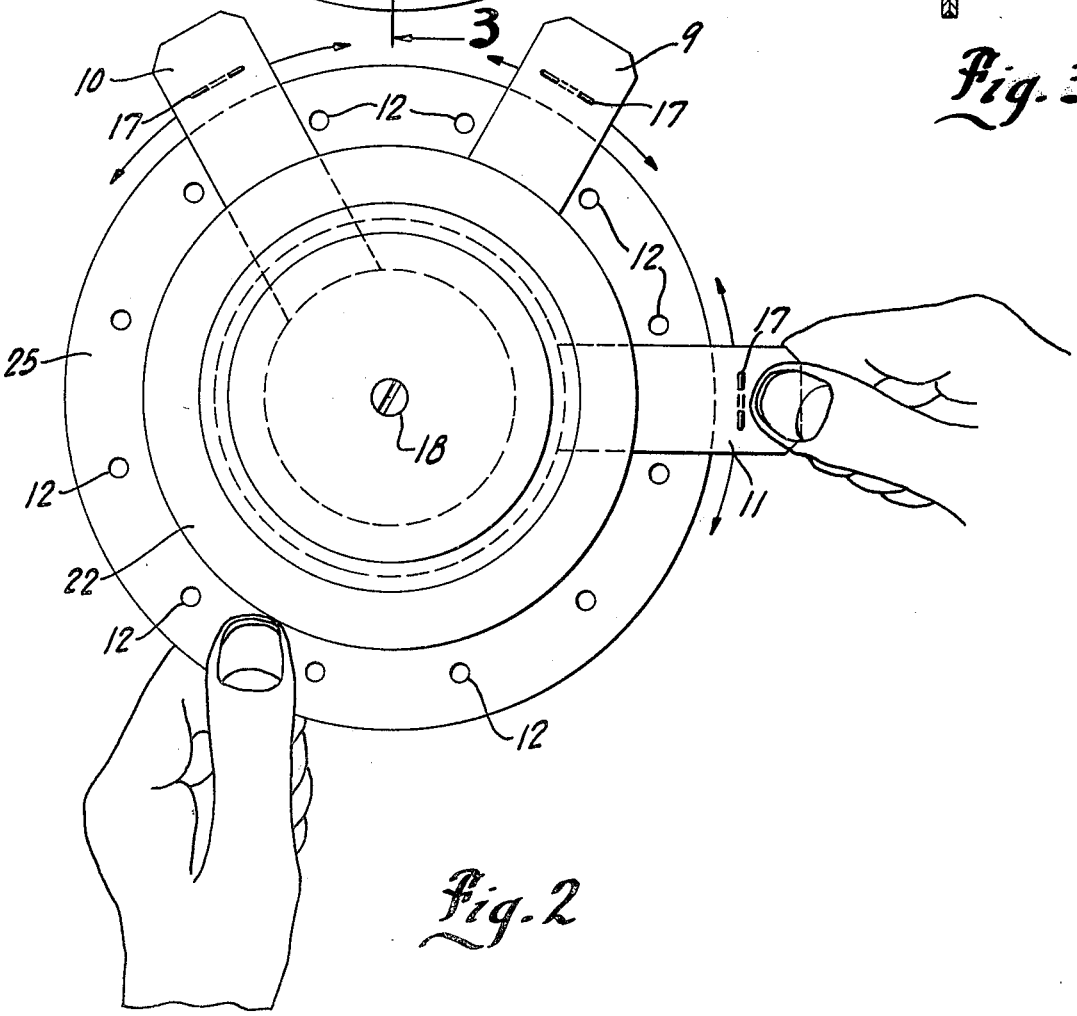
FIG. 2 is a back view of the device shown in FIG. 1 and illustrating the positioning of locating tabs by the bettor during the selection.

Referring to the drawings and particularly to FIGS. 1 through 3, the illustrated embodiment of the selector is a round, flat, disc-like unit having an apertured front cover 1 with several identifying windows or openings 2, 3, 4 and 5 as shown in FIG. 1 and an unmarked backside as shown in FIG. 2. The assembly as fully developed hereinafter, includes three separate rotatable discs 6, 7 and 8 rotatably mounted in stacked relationship to the backside of the front cover 1, and which carry horse identifying numbers which are exposed through openings 2 through 5. Positioning arms or tabs 9, 10 and 11 are secured one to each disc and projects outwardly of the front cover 1 to permit rotation of the discs 6 through 8 relative to each other and to the front cover 1 for selective location with respect to the openings 2 through 5. This provides for the alignment of different numbers on the discs with the respective openings and thereby provides for a completely arbitrarly presentation within the openings. In use, the bettor would hold the device as shown in FIG. 2 with the unmarked backside exposed. The tabs 9 through 11 are separately rotated and aligned with the locating indicia, shown as openings 12, to ensure alignment of a horse defining number within an opening. The ettor then reverses the position of the selector, exposing the numbers selected to himself.

Figure 4:
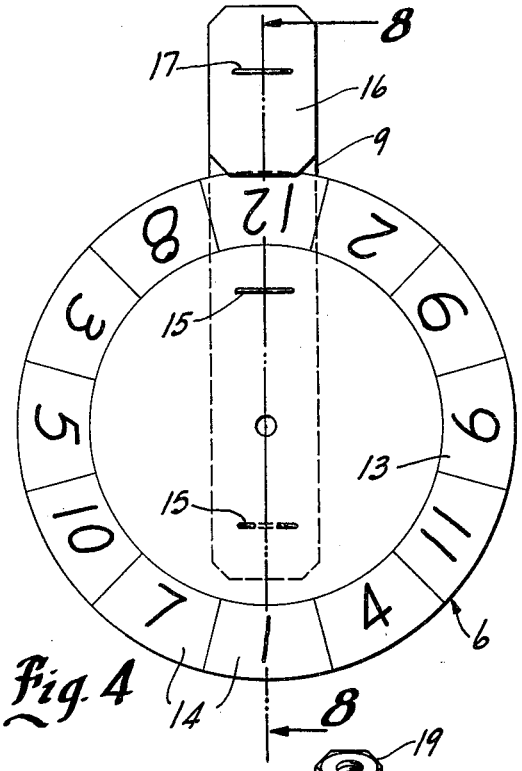
FIGS. 4–6 are elevational views of the several selection discs forming a part of the selector shown in FIGS. 1 and 2.
Figure 5:
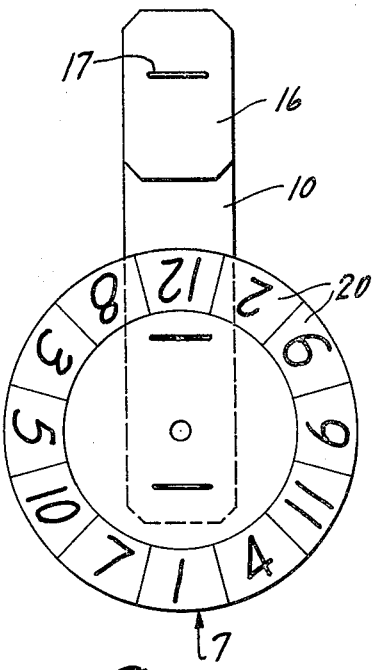
Figure 6:
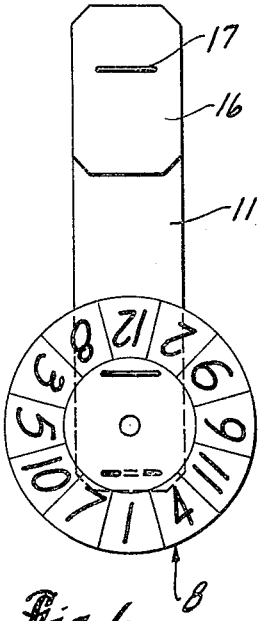

More particularly as shown in FIGS. 4 through 6 each race horse identifying disc is similarly constructed, but of a graduated diameter. The disc 6, shown in FIG. 4, is the largest of the three discs 6, 7 and 8, and includes an outer peripheral or marginal portion 13 divided into twelve equicircumferentially spaced segments or sectors 14. The numbers 1 through 12 are distributed within these seqments in nonsequential order, and in a completely arbitrary fashion. The disc 6 may be formed of any suitable material such as paper, cardboard, plastic, or even metal. It may of course be most conveniently formed of a paper with suitable supporting thereof to the cover 1 to form a stable, self-supporting disc-like assembly. The positioning or locating tab 9 is shown as a strip-like member which is affixed as by a simple staple 15 or any other suitable means to the central portion of the disc, and particularly to the backside thereof. The tab 9 extends outwardly beyond the edge of the disc a convenient distance for manual manipulation by the fingers of the bettor as shown in FIG. 2. The outermost and projecting end of the tab 9 is provided with a small reverse-extended clamping plate 16 which extends inwardly beyond the outermost periphery of the disc 9 and therefore cover 1. Plate 16 provides a holding action in the total assembly as more fully developed hereinafter. Plate 16 is shown secured by a staple 17.

Figure 7:
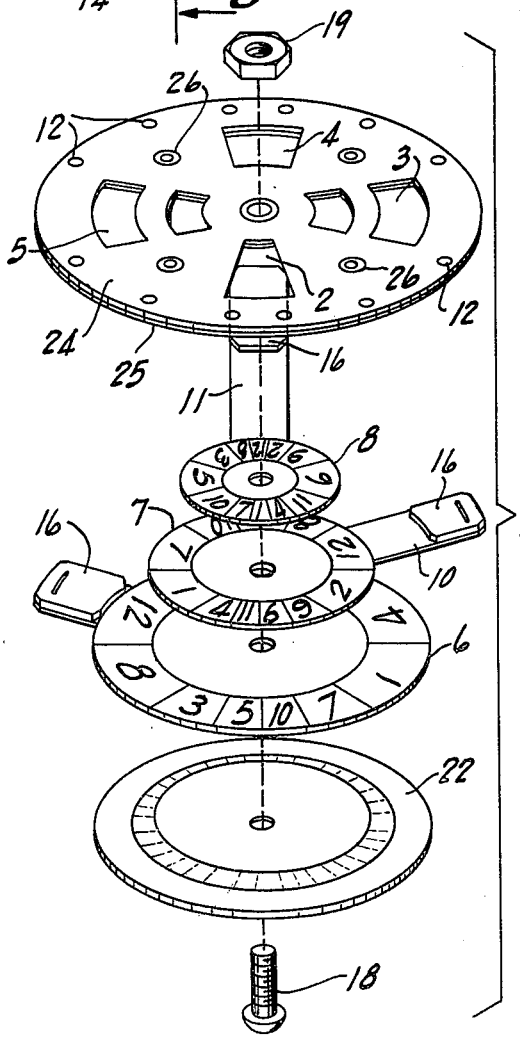
FIG. 7 is a pictorial exploded view of the device shown in FIGS. 1 through 6.
Figure 8:
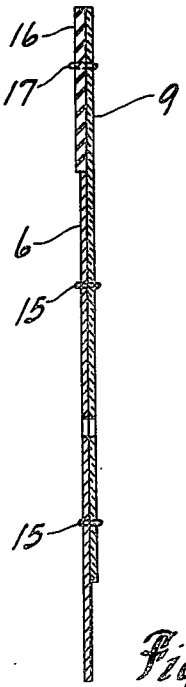
FIG. 8 is an enlarged cross-sectional view of individual largest disc element shown in FIG. 4.

The center of the disc 9, with the interconnected tab 15, is preferably apertured to fit over a pivot pin 18 which may be a simple screw member which receives a nut 19 to clamp the assembly together. The illustrated disc as shown in FIG. 4 includes a clear central portion within the confines of the outer numbered marginal portion. The second disc 7, as shown in FIG. 5, has an outer diameter corresponding to the inner diameter of the clear portion of the large disc and in the assembled position, as shown in FIG. 7, is aligned thereon. The second disc 7 is otherwise identically constructed in accordance with the first disc 6. Thus, disc 7 also includes an outer marginal portion with twelve equicircumferentially distributed numbered sectors 20. Within the sectors 20, the identical distribution as on disc 6 of the horse identifying numbers is provided. The locating tab 10 is similarly constructed and secured to the backside of the second disc 7. Tab 10 is of sufficient length to extend beyond the large disc 6 and therefore cover and locate the tab for convenient positioning. The tab 10 is preferably formed of a transparent plastic material at least outwardly from the margin of the second disc 7. In the assembled relationship, the second disc 7 is staked on top of the first disc 6 and tab 10 thus extends outwardly over the numbered marginal portion 13 and particularly sectors 14 of the first disc. As more fully developed hereinafter, the covered sector 14 may be aligned with one of the openings 2 through 5. The tab 10 must therefore be constructed to expose the aligned number of the first disc, through if the second tab 10 happens to be aligned with a presentation opening in the cover 1.

The second disc 7 also has a clear central portion and the third disc 8, as shown in FIG. 6, is suitably constructed to be staked within such clear portion of the second disc 7. Disc 8 is otherwise formed with the same twelve marginal sectors and with the identifying horse numbers distributed therein in accordance with the distribution of the first two discs 6 and 7. The third disc 8 also includes a similar positioning tab 11 with a clear portion which extends outwardly from the outer marginal edge. The total length of the tab 11 is the same as tab 9 to locate the outer finger end beyond the outer edge of cover 1, and is transparent to expose discs 6 and 7.

The three discs are located in superimposed stacked relationship, as most clearly shown in FIGS. 3 and 7, between a backing support plate 22 and the outer cover 1. The support plate 22 may be a simple dished plastic member or the like to provide additional support and rigidity to the assembly, particularly if the discs 6 through 8 are themselves formed of a thin, flexible paper, plastic or the like. If the disc members are formed of a relatively heavy self-supporting material such as a heavy cardboard or self-sustaining plastic or the like the backing plate 22 could of course be eliminated.

The cover 1 as most clearly shown in FIGS. 1, 3 and 7, is a round plate-like member having the four equicircumferentially spaced viewing windows or openings 2 through 5. The one opening 2 is of sufficient length to expose the aligned horse identify sectors 14 of all three discs 6, 7 and 8, and with the tabs 9 through 11 located between the locating indicia or openings 12. One of the numbered sectors 14 of each disc is aligned with opening 2. This opening thus provides the number for three different horses, identified as providing for the suggested "Win" "Place" and "Show" selection, as shown by the legend to the left of the opening 2. In addition, this number window, by providing number 3, with possible suggestive selections may also be used for the use and betting of a trifecta, as indicated along the right edge by the triple selection legend.

At 90° to opening 2, the second viewing opening 3 is located and includes two separate radially spaced opening sections separated by an integral continuous cover portion 23. These two openings 3 expose only the aligned sectors 14 of the innermost small disc 8 and the outermost large disc 6. The outermost opening 3 is selected as the second half of the Daily Double and is correspondingly identified. The inner opening 3 is identified as a long-shot type selection which arbitrarly identifies a horse which may do more than what would normally be anticipated, and in the illustrated embodiment is labeled as a "May Wake-Up" horse.

At 90° to such second opening 3 and directly opposite from the "Win" "Place" and "Show" opening 2 is viewing opening 4 which is constructed to expose the sectors 12 of largest disc 6 and the intermediate disc 7 with cofer 1 over the largest disc 6. This opening 4 is labelled for selections in a Quinella or the Perfecta races.

Finally, in the fourth quadrant or 90° from the opening 4, the opening 5 is provided consisting of a pair of openings similar to that of the Daily Double opening 3. Thus, opening 5 also exposes the sectors 14 of the innermost or smallest disc 8 and the largest disc 6.

The fourth section opening of the cover can be provided for any additional selections which would normally be provided by the considered judgement of the bettors. In the illustrated embodiment, the two numbers have been labelled by a suitable legend "Substitute For Nonrunners".

As previously noted, the tabs 9 through 11 should be held firmly in position when placed by the bettor as shown in FIG. 2. In the illustrated embodiment of the invention, the front cover 1 is formed as a two-piece unit having a front cover plate 24 and a backing plate 25 interconnected to each other and to the central pivot pin 18. The two plate members 24 and 25 are firmly interconnected with the marginally positions left free to permit spreading thereof. For example, simple rivets 26 located between the several viewing openings 2 through 5 are shown firmly interconnecting two relatively heavy cardboard plates 24 and 25 which hold the outer peripheral marginal portions of the plates in relatively close engagement. To hold the tabs 9 through 10 in position, the front locking plates 16 are inserted between the two plates 24 and 25 by merely separating of the two plates, bending the tab backwardly and inserting the tab plate 16 and releasing the plates 24 and 25. Each tab can be rotated to any desired location between the other tabs and the plates create a reliable grasp on the locating tab to hold the tab 9 through 10 in the desired position.

The selector may be made of a convenient size to carry in the pocket or the like of the bettor. Whenever the bettor desires to make a random selection, the selector is held as shown in FIG. 2, with the backside exposed. The bettor then sequentially grasps the individual tabs 9 through 10, and rotates them into alignment between two of the adjacent locating openings 12, knowing that this also provides alignment of the corresponding horse number sectors 14 with the several openings 2 through 5 to the reverse side of the selectors, although the particular numbers being exposed will of course not be known. When all three of the tabs 9 through 11 have been aligned, the bettor reverses the selector, thereby exposing the several horse identifying numbers in the openings 2 through 5. The innermost and intermediate disc tabs 10 and 11 may be aligned with anyone of the openings 2 through 5. However, the transparency of the tabs 10 and 11 exposes the corresponding number of the aligned disc. For example, as illustrated in FIG. 1, the small disc tab 10 is shown aligned with the Daily Double opening 2. The transparent portion of tab 10 is aligned with the exposed opening 2 overlying the large disc 6 and permits ready reading of the corresponding aligned number. To permit proper operation of the selectors, other exposure means could of course be used. The present invention provides very simple and acceptable random selector which may only be used infrequently by the bettor who generally will rely on his expert and considered judgement of the various factors recognized and given by racehorse/trotter handicappers.

Various modes in carrying out the invention are contemplated as being within the scope of the following claims, particularly pointing out and distinctly claiming the subject matter which is regarded as the invention.

I claim:

1. A race selector apparatus for selecting expected winners from individual participants in a plurality of sequentially run races, comprising a first element having a participant identifying sectors bearing indicia representing the individual participants, a second element having second sectors bearing similar indicia representing the several individual participants in the race, and a third element having third sectors bearing similar indicia representing the several individual participants in the race, a cover means having a plurality of presentation opening means spaning different portions of said elements and thereby different combinations of said sectors and means to cover and expose said opening means, means mounting said three elements adjacent each other with said sectors spaced from each other for movement relative to each other for aligning of different sectors, and means for positioning of said elements with respect to each other and said cover means and including index means for locating the sectors aligned with said presentation opening means with said opening means effectively closed, whereby the user locates the several elements in any one of the permitted positions for aligning of different sectors with the different presentation opening means and then effectively exposes said presentation opening means to determine randomly selected combination of participants in said plurality of opening means.

2. The apparatus of claim 1 wherein said elements are disc-like members of different diameters, said disc-like elements being stacked in relation with the peripheral portions exposed and with said such number identifying sectors being a plurality equicircumferentially distributed sectors on the exposed marginal portions.

3. The apparatus of claim 2 wherein said cover member is secured in overlying relationship to all of said discs and includes at least four equicircumferentially distributed presentation openings spaced in accordance with said sectors, at least one of said opening means spanning all three of the discs to simultaneously expose three aligned sectors of the three discs, each of the discs aligned with the openings being separately and arbitrarly identified as a win, place, and show selection, said three selections also permitting application of said three numbers to a Trifecta race.

4. The apparatus of claim 3 including a second of said opening means including a pair of radially spaced openings exposing the sectors of only two of the discs with one of said exposure such as being identified as the second half of the Daily Double to be associated with the win section of the first-named opening means, the second opening portion of the second presentation means being arbitrarly selected to identify another horse of a given predetermined characteristic.

5. The apparatus of claim 4 having a third presentation opening means including an opening spanning two adjacent discs and providing a pair of exposing two sectors for identifying horses for use in identifying a Quinella and/or Perfecta race selection.

6. The apparatus of claim 5 having fourth presentation opening means exposing at least one disc and being selected to identify other arbitrary horse identifications for use in wagering in a predetermined manner.

7. The apparatus of claim 2 wherein each of said discs includes a locating tab secured to the disc and extending outwardly beyond the outer edge of the cover, each of said locating tabs including a reverse clamping plate means secured hereto and extending inwardly from the outer end portion into engagement with the cover means to provide a friction gripping of the cover means for holding of the disc and locating tab in the preset position.

8. The apparatus of claim 7 wherein said cover includes first and second round plate-like members secured to each other with opposed movable marginal portions, said clamping plate means being located between said marginal portions.

9. The apparatus of claim 7 wherein each of said discs is formed of a thin paper-like member, a solid continuous backing member forming a backcover for said paper members and a strengthening support for said members, pin means passed through the backing member and discs and cover and holding all elements in abutting relation to said cover, said cover extending outwardly of said backing member and including said locating means in the form of equicircumferentially spaced openings whereby each pair of adjacent openings define a proper tab location for aligning and exposing a disc sector within an opening.

* * * * *